US010196744B2

(12) United States Patent
Lallemand et al.

(10) Patent No.: US 10,196,744 B2
(45) Date of Patent: Feb. 5, 2019

(54) SURFACE TREATMENT OF METAL SUBSTRATES

(71) Applicants: APERAM, Luxembourg (LU); UNIVERSITE DE FRANCHE-COMTE, Besançon (FR)

(72) Inventors: Fabrice Lallemand, Bussiéres (FR); Xavier Roizard, Besançon (FR); Jean-Marie Melot, Peseux (FR); Aurélien Buteri, Bethune (FR); Mélanie Borgeot, Besançon (FR); Romain Evrard, Houplines (FR)

(73) Assignees: APERAM, Luxembourg (FR); UNIVERSITE DE FRANCHE-COMTE, Besançon (FR)

( * ) Notice: Subject to any disclaimer, the term of this patent is extended or adjusted under 35 U.S.C. 154(b) by 0 days.

(21) Appl. No.: 15/514,809

(22) PCT Filed: Sep. 25, 2015

(86) PCT No.: PCT/EP2015/072172
§ 371 (c)(1),
(2) Date: Mar. 27, 2017

(87) PCT Pub. No.: WO2016/046401
PCT Pub. Date: Mar. 31, 2016

(65) Prior Publication Data

US 2018/0119287 A1 May 3, 2018

(30) Foreign Application Priority Data

Sep. 26, 2014 (FR) ..... 14 59158

(51) Int. Cl.
*C23C 22/03* (2006.01)
*C23C 22/06* (2006.01)
(Continued)

(52) U.S. Cl.
CPC ..... *C23C 22/07* (2013.01); *C10M 105/74* (2013.01); *C10M 137/12* (2013.01); *C23C 22/03* (2013.01);
(Continued)

(58) Field of Classification Search
CPC ..... C23C 22/07; C23C 22/03; C23C 22/06; C10M 105/74; C10M 137/12;
(Continued)

(56) References Cited

U.S. PATENT DOCUMENTS 4,048,374 A 9/1977 Kotzsch et al.
5,103,550 A * 4/1992 Wefers ..... B05D 7/14 148/253

(Continued)

FOREIGN PATENT DOCUMENTS

EP 1 927 676 A2 6/2008
WO 99/66104 A2 12/1999
WO 2009/000820 A2 12/2008

OTHER PUBLICATIONS

Moine et al., "Grafting and Characterization of Dodecylphosphonic Acid on Copper: Macro-Tribological Behavior and Surface Properties", Surface & Coatings Technology, vol. 232, (2013), pp. 567-574.

(Continued)

*Primary Examiner* — James C Goloboy
(74) *Attorney, Agent, or Firm* — Oliff PLC

(57) ABSTRACT

A process for surface treatment of metal substrates, including the steps of: providing a metal substrate including hydroxyl groups at its surface; bringing the metal substrate into contact with a solution of at least one organophosphorus compound to enable the reaction of the hydroxyl groups at the surface of the metal substrate with the organophosphorus compound to form a monomolecular layer over the surface (Continued)

Figure 1:
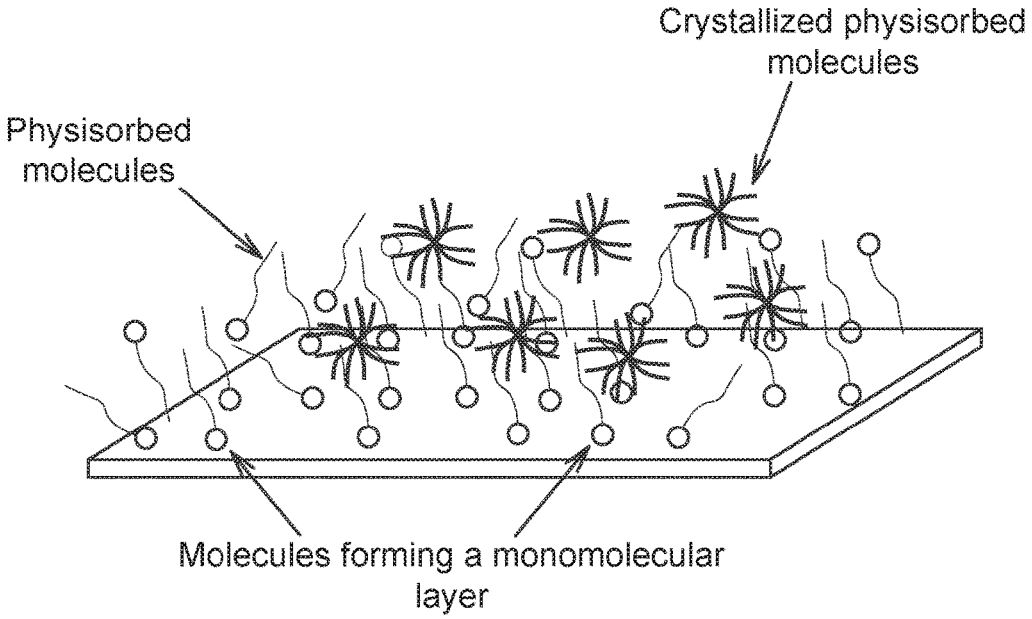

and a second layer of physisorbed organophosphorus molecules at least preponderantly crystallized, the obtained treated substrate being coated with the organophosphorus compound in the form of a first monomolecular layer coating at least 15% of the surface of the substrate and in the form of a physisorbed second layer at least preponderantly crystallized. A treated metal substrate which may be obtained by the process thereof, corresponding solution and its use for treating metallic substrates to improve their tribological properties during their shaping, in particular their stamping.

11 Claims, 9 Drawing Sheets

(51) Int. Cl.
*C23C 22/07* (2006.01)
*C10M 105/74* (2006.01)
*C10M 137/12* (2006.01)
*C23F 11/167* (2006.01)

(52) U.S. Cl.
CPC ..... *C23C 22/06* (2013.01); *C23F 11/1676* (2013.01); *C10M 2223/06* (2013.01); *C10M 2223/0603* (2013.01); *C10N 2230/06* (2013.01); *C10N 2230/12* (2013.01); *C10N 2240/402* (2013.01); *C10N 2240/406* (2013.01); *C10N 2240/407* (2013.01); *C10N 2240/408* (2013.01); *C10N 2240/409* (2013.01); *C10N 2250/14* (2013.01)

(58) Field of Classification Search
CPC ..... C10M 2223/06; C10M 2223/0603; C10N 2240/402; C10N 2240/406; C10N 2240/407; C10N 2240/408; C10N 2240/409; C10N 2250/14
See application file for complete search history.

(56) References Cited

U.S. PATENT DOCUMENTS 5,853,797 A * 12/1998 Fuchs ..... C10M 169/04 427/58
2009/0324834 A1 12/2009 Hanson

OTHER PUBLICATIONS

X. Roizard et al., "Experimental Device for Tribological Measurement Aspects in Deep Drawing Process", Journal of Materials Processing Technology, vol. 209, (2009), pp. 1220-1230.
Dec. 18, 2015 Search Report issued in International Patent Application No. PCT/EP2015/072172.
Harm U et al., "Quervemetzte Molekulfilme fur den Korrosionsschutz verzinkter Stahloberflachen", Galvanotechnik, Eugen G. Leuze Verlag, Saulgau/Wurtt, DE, vol. 102, No. 10, Oct. 1, 2011, pp. 2190-2198.

* cited by examiner b)

a)

b)

a)

SURFACE TREATMENT OF METAL SUBSTRATES

TECHNICAL FIELD

The present invention relates to a method for surface treatment of metal substrates, in particular of stainless steel, in order to improve their properties, in particular the tribological characteristics during their shaping, in particular by stamping.

TECHNOLOGICAL BACKGROUND

Combining durability, good mechanical properties, hygiene and ease of maintenance, the stainless steel has nowadays become the reference material in numerous fields such as the car industry, the consumer goods industry, the heavy industry, microtechnology and electronics.

In a general manner, the preparation of the finished product requires at least one forming operation, for example a stamping for flat products. The field in which a metal is deformed with neither striction nor breakup largely depends on the performances of the used lubricant.

However, the use of usual stamping oils poses increasing problems. First of all, the oils, in particular the most performing oils, are not always easy to implement. Their viscosity may cause application difficulties and the amount required to cover the substrate may be substantial. Moreover, the use of these oils requires a meticulous cleaning of the sheet metal as well as the tools and the workstation. Finally, the retreatment of these oils after use poses serious environmental problems, especially when these consist of chlorinated or sulfurized oils.

Furthermore, these lubricants do not always provide the required performance, which may cause substantial costs. Indeed, an insufficient lubrication increases the number of disposals of shaped products. This may also increase the number of maintenance interventions (rectifications, polishing, . . . ) and therefore their wearing. In this respect, the chlorinated or sulfurized oils are the most satisfactory ones. But, it has been seen that they pose environmental problems which may become prohibitive given the possible regulatory evolutions.

Technical Problem

A purpose of the invention is to propose a method allowing conferring to metal substrates the properties required to allow their shaping, in particular by stamping, without the use of any separate complementary lubricant.

Another purpose of the present invention is to propose such a method allowing improving the tribological properties of a metal substrate during its shaping.

Another purpose of the present invention is to propose metal substrates having tribological properties, in particular during their shaping.

Still another purpose of the present invention is to propose a surface treatment solution which may substitute for existing industrial lubricants, which does not have the drawbacks mentioned hereinabove, in particular the environmental ones.

Proposed Solution According to the Invention

These purposes and others are reached according to the invention by a treatment in which the surface of the metal substrate is brought into contact with a solution of organophosphorus compounds so as to form a coating composed of a chemisorbed first layer at the metallic surface in which the organophosphorus compounds are organized in the form of a monomolecular layer and of a second layer of physisorbed organophosphorus molecules at least preponderantly crystallized.

In general, the first monomolecular layer includes covalent-type bonds with hydroxyl groups present at the surface of the metal substrate. The organophosphorus compounds may be considered as being chemisorbed thereon. Thus, the first layer has a strong adherence to the substrate. In contrast, the molecules constitutive of the second layer have weak links with the substrate, of the Van-der-Waals type. The organophosphorus compounds may be considered as being physisorbed thereon (see FIG. 1). This second layer, at least preponderantly crystallized (that is to say crystallized by at least 50% of its mass and of its molecules), therefore has a lesser adherence to the substrate.

The process of the invention confers very interesting properties to the metal substrates, in particular with regard to their tribological properties during their shaping.

Indeed, the inventors have observed that the coating of organophosphorus compounds formed as previously described has astonishing lubricating qualities, comparable to and even higher than those of the best lubricants available in the market.

Moreover, advantageously, the coating deposited according to the invention confers an improved corrosion resistance to the metal substrate.

Hence, the metal substrates treated according to the invention may be lubricated well before their shaping, which has notable advantages. Indeed, the lubricating coating contributes to an easy handling, reduces the risk of corrosion, in particular during transport, and greatly facilitates the subsequent shaping, since it frees from the need of using a separate complementary lubricant, generally in the form of an oil or of a polymer coating, while not degrading the lubrication performances and preserving the integrity of the tools from a premature wearing.

The absence of oil allows a financial saving and the preservation of the environment. In addition, it allows cleaning the workstation and the tools by simple dusting, which constitutes a substantial time saving.

Hence, the process of the present invention offers a performant solution for treatment of metal substrates adapted to shaping processes, in particular to stamping, in both economic and environmental terms.

Indeed, the used organophosphorus compounds are barely toxic and may be implemented in a barely toxic solvent, in particular an alcohol and/or water, a 100% alcoholic solution (including ethanol, in particular absolute ethanol, is a privileged example) being preferred. Hence, the implementation of such a solution does not cause regulatory difficulties, and its withdrawal does not pose risks to the environment.

Moreover, the organophosphorus compounds are used in solution, which reduces the amount required to confer the pursued properties in comparison with oils, and further contributes to the economical and ecological interest of the method of the invention.

Also, according to a first aspect, the invention relates to a process for surface treatment of metal substrates, comprising the steps of:

(i) providing a metal substrate including hydroxyl groups at its surface;

(ii) bringing the metal substrate into contact with a solution of at least one organophosphorus compound so as to enable the reaction of said hydroxyl groups at the surface of the metal substrate with said organophosphorus compound to form a monomolecular layer over at least 15% of the surface of the metal substrate and, over said monomolecular layer, a second layer of physisorbed organophosphorus molecules at least preponderantly crystallized, the obtained treated substrate being coated with the organophosphorus compound in the monomolecular form and in the physisorbed form at least preponderantly crystallized.

Preferably, the at least one organophosphorus compound is of formula (I) below

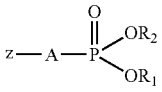

(I)

wherein

A represents a hydrocarbon chain, saturated or unsaturated, straight or branched, comprising 4 to 28 atoms of carbon, the chain may be substituted with one or several group(s) chosen among hydroxy, amino, cyano, halogen, sulfonic acid, organophosphonic acid and/or interrupted by one or several atom(s) or group(s) chosen among O, HN or SH;

Z represents one or several terminal functional group(s) chosen among alcohol, aldehyde, carboxylic acid, phosphonic acid, thiol, amine, halogen, cyano or silane, or is absent; and $R_1$ and $R_2$ are, independently of each other, a hydrogen or a saturated alkyl, straight or branched, comprising 1 to 18 atoms of carbon.

Among these compounds of formula (I) are preferred those in which:

A is a saturated alkyl group; and/or

A is a straight alkyl group.

The organophosphorus compounds are implemented in the process of the invention in the form of a solution. Preferably, the solvent comprises an alcohol, in particular an alcohol chosen among methanol, ethanol, propanol, isopropanol and butanol, and/or water.

Advantageously, the used solution of the organophosphorus compound has a concentration of more than 1 mM/l and preferably from 10 to 1000 mM/l, advantageously from 20 to 500 mM/l, and in particular from 50 to 200 mM/l. Preferably, the solution of the organophosphorus compound is supersaturated.

In particular, the substrate treated by the method of the invention may be a substrate made of iron, nickel, cobalt, aluminum, copper, chromium, titanium, zinc, gold, silver, ruthenium, rhodium or any of their alloys, in particular the steels such as the stainless steels, the carbon steels and the electrical steels.

According to a second aspect, the invention relates to a treated metal substrate which may be obtained by the process of the invention.

In particular, it may consist of a substrate made of iron, nickel, cobalt or any of their alloys. Alternatively, it may consist of a substrate made of aluminum, copper, chromium, titanium, zinc, gold, silver, ruthenium, rhodium or any of their alloys.

In particular, the metal substrate may be a flat product.

According to a third aspect, the invention relates to a surface treatment solution comprising at least one organophosphorus compound of formula (I) below

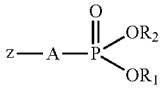

(I)

wherein:

A represents a hydrocarbon chain, saturated or unsaturated, straight or branched, comprising 4 to 28 atoms of carbon, preferably 16 atoms of carbon, the chain may be substituted with one or several group(s) chosen among hydroxy, amino, cyano, halogen, sulfonic acid, phosphonic acid and/or interrupted by one or several atom(s) or group(s) chosen among O, HN or SH;

Z represents one or several terminal functional group(s) chosen among alcohol, aldehyde, carboxylic acid, phosphonic acid, thiol, amine, halogen, cyano or silane or is absent; and $R_1$ and $R_2$ are, independently of each other, a hydrogen or a saturated alkyl, straight or branched, comprising 1 to 18 atoms of carbon, in a solvent comprising an alcohol, in particular methanol, ethanol, propanol, isopropanol and butanol, possibly water-added, the concentration of the organophosphorus compound of formula (I) in the solution being of more than 1 mM/l.

Finally, according to a fourth aspect, the invention concerns the use of such a solution for the treatment of metal substrates in order to improve their tribological properties during their shaping, in particular during stamping.

[Detailed Description of the Invention]

The inventors have unexpectedly discovered that a metal substrate treated according to the invention has tribological properties during its shaping which are higher than or equivalent to a substrate treated with conventional lubricating oils. It has also been observed, accessorily, that such a treatment is likely to confer a substantially improved corrosion resistance to the metal substrate.

The obtained results highlight the fact that these particular properties of the coating result from the presence of organophosphorus compounds both in the chemisorbed form and in the physisorbed form at least preponderantly crystallized.

Indeed, under the conditions of the process of the invention, the surface of the metal substrate is first grafted by a very fine monomolecular layer of the organophosphorus compound. The grafting takes place by reaction of the phosphonic groups with at least part of the hydroxyl groups present at the surface of the metal. This results in that the first layer is linked to the substrate by covalent-type bonds, and firmly adheres to the metallic surface. Furthermore, the monomolecular layer may be self-assembled. But this is not mandatory at all, thereby enabling rapidity and simplicity of implementation of the treatment in terms of time and number of steps. An advantage of the process according to the invention, in an industrial application, is actually that it does not necessitate allowing time for the monomolecular layer to be self-assembled, and even it does not necessitate that the monomolecular layer coats the entire surface of the substrate. A coating of at least 15% of the surface of the substrate is already sufficient. It is possible to proceed to the shaping almost immediately after the coating of the substrate, as soon as the solvent has evaporated. On the other hand, it becomes preferable to work with high concentrations of the organophosphorus compound in the solvent, optimally in supersaturation.

By «self-assembled monolayer», is meant a layer which may be defined as a molecular assembly which is formed spontaneously over time by immersion of a substrate in a solution containing an active surfactant, until the formation of a perfectly arranged monolayer.

According to the invention, the coating of the metal substrate further includes, disposed over said monomolecular layer, a second layer of physisorbed molecules of the organophosphorus compound at least preponderantly crystallized. By «at least preponderantly», is meant that at least 50% of the compound is in the crystallized form. This second layer is clearly thicker in comparison with the first layer. Most often, it is possible to detect its presence with the naked eye. Since the underlying monomolecular layer covers at least 15% of the reactive sites, the second layer is not linked everywhere to the substrate by strong covalent-type bonds, this is all the more as the second layer is at least preponderantly crystallized. Hence, the adhesion of the second layer results from other bonds, for example of the Van der Waals type, in particular with the underlying organophosphorus molecules grafted to the metal. This second layer may be considered as physisorbed. Furthermore, in the second layer, the molecules of the organophosphorus compound are at least preponderantly crystallized. In order to preserve the superficial layer and to ensure the pursued effect, it is therefore important that the process of the invention does not include subsequent steps likely to eliminate at least the second layer, or is not followed by such steps before the shaping of the product, or, in a general manner, before any operation during which the presence of the second layer would be advantageous.

[Process]

The present invention mainly concerns a process for treating metal substrates allowing improving their tribological behavior during their shaping, and possibly also their corrosion resistance.

In its widest definition, this process is characterized by the deposition on the substrate of a coating of an organophosphorus compound with the particularity that the compound is provided in a double form.

Indeed, the coating includes a first monomolecular layer which is not necessarily self-assembled, which is in contact with at least 15% of the surface of the substrate, and is linked to the substrate by means of covalent-type bonds, and, above this first layer (and above the substrate in the areas where it is not covered by the first layer, if any), it includes a second layer in which the compound is both in the physisorbed form and, at least preponderantly, crystallized, with a low adherence of the second layer on the first surface, and also on the substrate in the possible areas not covered by the first layer.

It is the presence of the organophosphorus compound in these two distinct forms which allows the obtainment of the desired technical effects, without the need to add other compounds to the treatment solution, or of an additional layer of any product on the surface of the material to be shaped.

As mentioned hereinabove, according to a first aspect, the invention concerns a process for surface treatment of metal substrates, comprising the steps of:

(i) providing a metal substrate including hydroxyl groups at its surface;

(ii) bringing the metal substrate into contact with a solution of at least one organophosphorus compound so as to enable the reaction of said hydroxyl groups at the surface of the metal substrate with said organophosphorus compound so as to form a chemisorbed monomolecular layer, not necessarily self-assembled, over the surface, and a second layer of physisorbed organophosphorus molecules at least preponderantly crystallized, the obtained treated substrate being, ultimately, coated with the organophosphorus compound in the chemisorbed form (the monomolecular layer) and in the physisorbed form at least preponderantly crystallized (the second layer).

The process of the invention may be used on substrates with various natures and shapes.

Nevertheless, the metal must be oxidizable, spontaneously or not, and therefore likely to present hydroxyl groups at its surface. Thus, it may consist of substrates based on iron, nickel, cobalt, aluminum, copper, chromium, titanium, zinc, gold, silver, ruthenium, rhodium or based on one of their alloys such as stainless steels, carbon steels or still electrical steels.

The metal substrate may be a substrate made of massive metal or, possibly, a composite substrate, but it will include a surface which is made of metal at least partially.

In order to dispose hydroxyl groups at the surface, it is not generally necessary to subject the metal substrate to a particular treatment. Indeed, with the exception of certain metals or alloys, the ambient conditions suffice to oxidize the surface, thereby creating the hydroxyl groups which react with the phosphonic function.

The metal may be a pure metal but most often it will consist of a metallic alloy. Are particularly concerned in the process of the invention, the steels, in particular the stainless steels, the carbon steels, the electrical steels (Fe—Si) but also the ferrous alloys with high added value (Fe—Ni, Fe—Co). Nonetheless, it may also consist of non-ferrous metals such as aluminum, copper, chromium, nickel, cobalt, titanium, zinc, gold, silver, ruthenium and rhodium or the alloys thereof.

The shape of the substrate may be very variable. Thus, it is possible to use as a substrate, for example, flat products intended, in particular, to be deep-drawn, with a thickness comprised between 0.04 mm and 20 mm, with a preference for a thickness comprised between 0.4 and 2.5 mm, tubes, wires, or still products intended to cutting (in particular for substrates the thickness of which is less than 4 mm).

Nonetheless, it is also possible to consider implementing the process of the invention, to also treat the products which will be shaped, in particular in order to ensure the corrosion resistance during the transport or before the surface treatment.

Preferably, the at least one organophosphorus compound is of formula (I) below

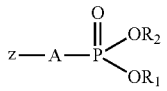

(I)

wherein

A represents a hydrocarbon chain, saturated or unsaturated, straight or branched, comprising 4 to 28 atoms of carbon, preferably 16 atoms of carbon, the chain may be substituted with one or several group(s) chosen among hydroxy, amino, cyano, halogen, sulfonic acid, phosphonic acid and/or interrupted by one or several atom(s) or group(s) chosen among O, HN or SH;

Z represents one or several terminal functional group(s) chosen among alcohol, aldehyde, carboxylic acid, phosphonic acid, thiol, amine, halogen, cyano or silane, or is absent; and $R_1$ and $R_2$ are, independently of each other, a hydrogen or a saturated alkyl e, straight or branched, comprising 1 to 18 atoms of carbon.

Among these compounds of formula (I) are preferred those in which:

$R_1$ and $R_2$ are hydrogen;

$R_1$ and/or $R_2$ are methyl, ethyl, propyl, isopropyl, isobutyl, tert.butyl or n-butyle;

Z is absent;

Z is an halogen, in particular fluoro, chloro, bromo or iodo;

Z is the carboxylic acid;

Z is thiol;

Z is silane;

Z is not the phosphonic acid;

A is a saturated alkyl group;

A is a straight alkyl group;

A does not carry a phosphonic acid;

A is an alkyl group including 4 to 20 atoms of carbon;

A is an alkyl group including 14 to 18 atoms of carbon; and/or

A is an alkyl group including 16 atoms of carbon.

The tests on stainless steel have concluded that a length of the chain A of 16 atoms of carbon would lead to an optimum implementation of the process according to the invention, at least in this case.

The preferred organophosphorus compounds of formula (I) are those in which Z represents a functional group chosen among the carboxylic acid, thiol or silane or in which Z is absent.

Are particularly preferred the compounds of formula (I) in which the chain A is straight and saturated and includes only C and H atoms, and therefore those where Z is absent.

In the event where they are not available in the market, these compounds may be easily synthesized by adapting the procedure described in the article of M. M. Moine& al. (2013) titled «Grafting and characterization of dodecylphosphonic acid on copper: macro-tribological behavior and surface properties » (Surface & Coatings Technology).

The organophosphorus compounds include portions with different polarities. Thus, the end comprising the phosphonic group is polar and has an affinity for the hydroxyl groups. The phosphonic group reacts by an acid/base reaction with the surface oxide of the substrate and forms a strong semi-covalent bond between the molecule and the substrate. Hence, the organophosphonic end is fixed on the metallic surface.

At their other end, the organophosphorus compounds may include a less polar group, for example a carbon chain possibly substituted tending to confer a preferred orientation thereto with respect to the metallic surface.

This preferred orientation ultimately leads to a perfectly arranged self-assembled monolayer. The resulting order is also called self-assembly. However, as has been said, this characteristic is not mandatory, and the material may be shaped industrially before reaching this self-assembly state.

The grafting of the organophosphorus compounds on the metal surface may be performed by simple contact between the metallic surface and the solution. Thus, the step (ii) of the process allows bringing the metallic surface into contact with the organophosphorus compounds in solution. This step may be performed by different conventional means, for example by the Langmuir Blodgett technique, by immersion in a solution bath, by spraying of the solution, by roller application or still by spreading also called spin coating.

According to a preferred embodiment, the contact is performed by spraying the solution containing the organophosphorus compounds over the metal substrate. This contact mode is particularly advantageous because it is rapid and therefore compatible with an industrial production rate. Unexpectedly, it has been observed that the quality of the formed coating is sufficient to improve the tribological properties in a significant manner.

The time of contact necessary to obtain an optimum result in tribological terms may vary depending on the reactivity of the substrate and of the chosen organophosphorus compounds. It may also depend on other parameters such as the temperature and the concentration of the solution. However, the reaction is generally considered as sufficient after a contact for a duration which may be as short as one or a few seconds.

Thus, the duration of contact of the metal surface with the solution of organophosphorus compounds is preferably from 1 second to 600 minutes, still better from 1 to 60 seconds.

The process of the invention does not require any heavy and costly equipment. It is rapid and may be performed on large-sized surfaces.

[Modified Metal Substrates]

It has been highlighted by different characterization techniques and in particular by contact angles measurement, by X-ray photoelectron spectroscopy (XPS), and by infrared spectroscopy that the treated substrates are coated with a layer of organophosphorus compounds. In general, the preponderantly crystallized physisorbed second layer is visible to the naked eye.

The treated metal substrates have characteristics different from the non-treated substrates, in particular in terms of tribological properties during their shaping. These characteristics allow considering their shaping without the use of an additional conventional lubricant, in particular without a lubricant in the form of an oil or polymer.

Advantageously, such substrates further have a better corrosion resistance, in particular during storage and transport.

According to a second aspect, the invention therefore concerns a treated metal substrate which may be obtained by the process of the invention.

The absence of lubricant during the subsequent shaping step is advantageous since it frees from the need of cleaning the substrates and the tools which is often very costly and time-consuming. Thus, a non-negligible time saving is possible on the steps subsequent to the shaping, in particular the stamping step. Moreover, the performance of the associated lubrication preserves the tooling, subjected to a severe wearing in the case of an inappropriate and/or ineffective lubrication.

[Solution]

The grafting of the surface of the metal substrate is performed by contact with a solution of an organophosphorus compound.

Indeed, one of the advantages of the process lies in the effectiveness of the organophosphorus compounds. Moreover, considering their good solubility in water and/or in common alcohols, it appears advantageous to implement the compound in the form of a solution.

Most of the organophosphorus compounds of formula (I) are soluble in water and/or one of the alcohols chosen among methanol, ethanol, propanol, isopropanol and butanol. The non-aerated absolute alcohol is a privileged example, because of its low cost, its low evaporation temperature and its moderate toxicity. The absence of oxygen dissolved in the solvent is not requisite, since the duration of exposure of the organophosphorus compounds to the solvent may be short, and since the dissolved oxygen then has no time to denature them.

In certain embodiments of the process, the concentration of the solution of organophosphorus compounds may have an impact on the amount of the physisorbed compound formed at the surface of the metal. That being said, the process is not limited to a specific concentration range. It should only be ensured that the amount of the organophosphorus compound deposited on the metal surface is sufficient to form both a chemisorbed monomolecular layer and a physisorbed second layer at least preponderantly crystallized.

Thus, the treatment solution comprises more than 1, and preferably from 10 to 1000, advantageously from 20 to 500 and in particular from 20 to 50 mM/l of the organophosphorus compound of formula (I) hereinabove. Preferably, in order to ensure the success of the treatment, a supersaturated solution of the organophosphorus compound(s) is used, bearing in mind that in the range from 20 to 50 mM/l, for the considered preferred molecules, this supersaturation is already reached.

According to a third aspect, the invention concerns a treatment solution comprising at least one organophosphonic compound of formula (I) below

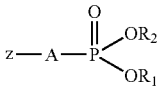

(I)

wherein:

A represents a hydrocarbon chain, saturated or unsaturated, straight or branched, comprising 4 to 28 atoms of carbon, preferably 16 atoms of carbon, the chain may be substituted with one or several group(s) chosen among hydroxy, amino, cyano, halogen, sulfonic acid, phosphonic acid and/or interrupted by one or several atom(s) or group(s) chosen among O, HN or SH;

Z represents one or several terminal functional group(s) chosen among alcohol, aldehyde, carboxylic acid, phosphonic acid, thiol, amine, halogen, cyano or silane or is absent; and $R_1$ and $R_2$ are, independently of each other, a hydrogen or a saturated alkyl, straight or branched, comprising 1 to 18 atoms of carbon, in a solvent comprising an alcohol, in particular methanol, ethanol, propanol, isopropanol and butanol, possibly water-added, the concentration of the organophosphorus compound of formula (I) in the solution being of more than 1 mM/l.

Of course, the solution may further contain other additives common in the field such as preservatives, emulsifiers, pigments or still additives for withstanding high pressures.

The solution of organophosphorus compounds may be prepared in a conventional manner. In principle, the organophosphorus compounds are introduced in the solvent, although the reverse way may also be performed. In order to accelerate the dissolution of the organophosphorus compounds, it is possible to stir and if appropriate heat the solution.

[Use of the Lubricating Solution]

Finally, according to a fourth aspect, the invention concerns a use of such a solution for the treatment of metal substrates in order to improve their tribological properties during their shaping, in particular during stamping.

Figure 2:
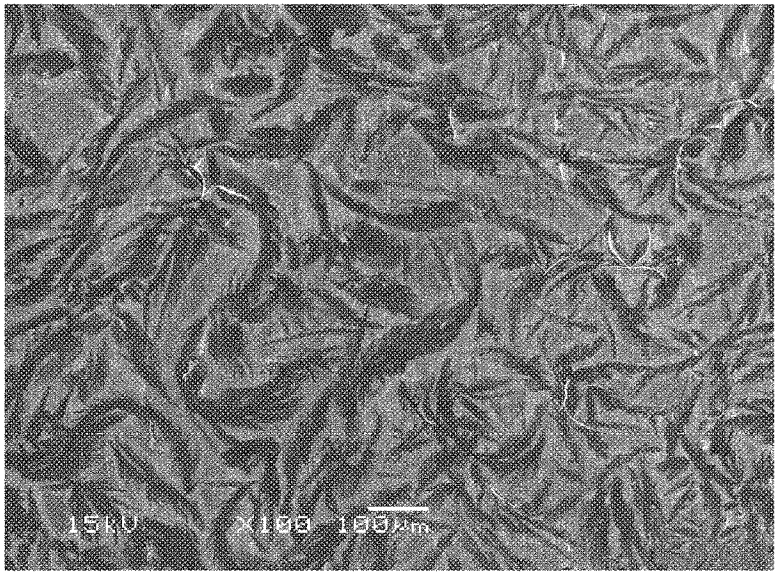
Figure 2:
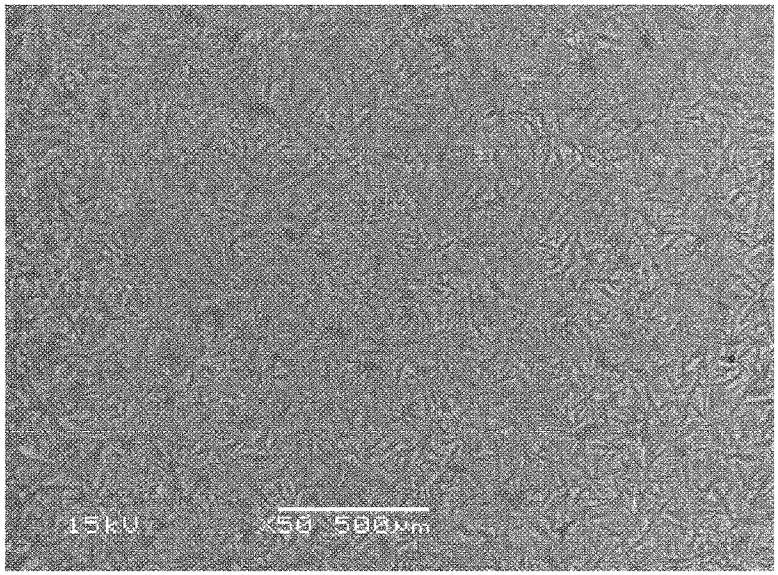
Figure 3:
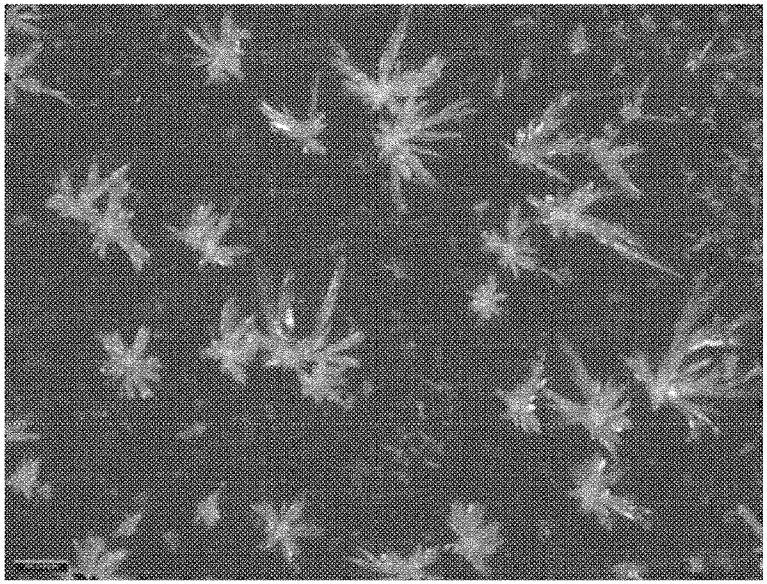
Figure 3:
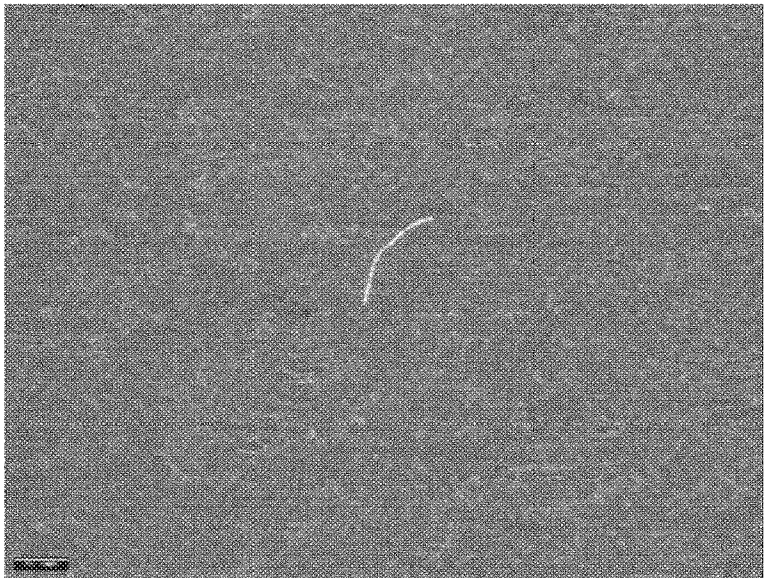

The invention will be described in more detail by means of the examples which follow, and of the figures, which show:

FIG. 1: a schematic diagram of a coated metal substrate which may be obtained by the process of the invention, including a monomolecular layer of an organophosphorus compound and a second layer of preponderantly crystallized molecules of the organophosphorus compound;

FIGS. 2 (*a*) and (*b*): micrographies obtained by scanning electron microscopy of the surface of a ferritic (grade 1.4509-4441) stainless steel substrate treated according to the example 139 highlighting the existence of a crystallized physisorbed layer;

FIGS. 3 (*a*) and (*b*): micrographies obtained by scanning electron microscopy of the surface of a ferritic (grade 1.4509-441) stainless steel substrate treated according to the examples 141 (a) and 153 (b) respectively highlighting the influence of the concentration of organophosphorus molecules on the existence of a crystallized physisorbed layer.

Figure 4:
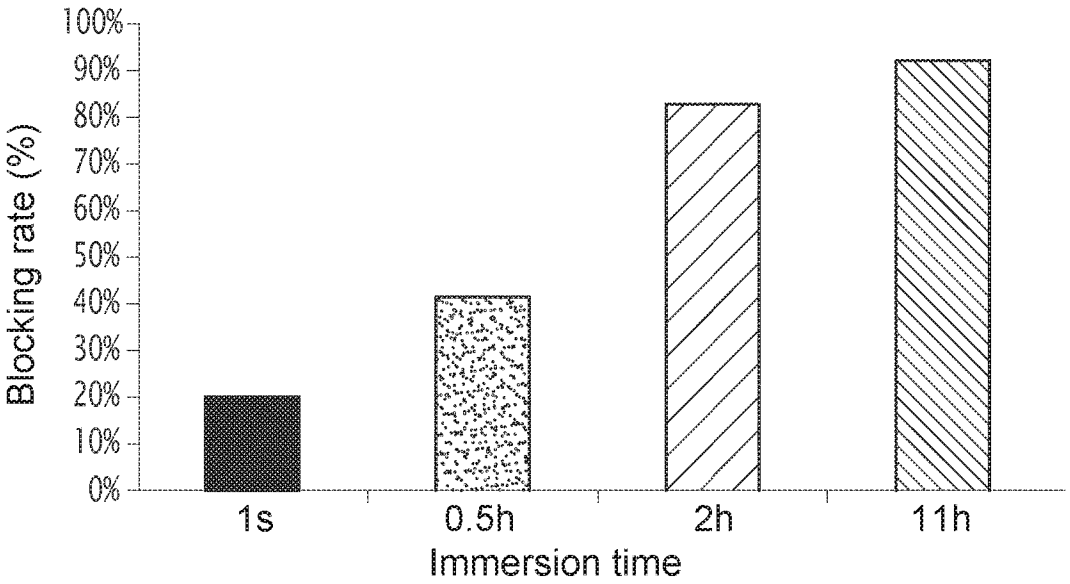

FIG. 4: the determination of the blocking rate performed by cyclic voltammetry of austenitic (grade 1.4301-304) stainless steel substrates treated according to the examples 73 (A), 74 (B), 75 (C) and 76 (D).

Figure 5:
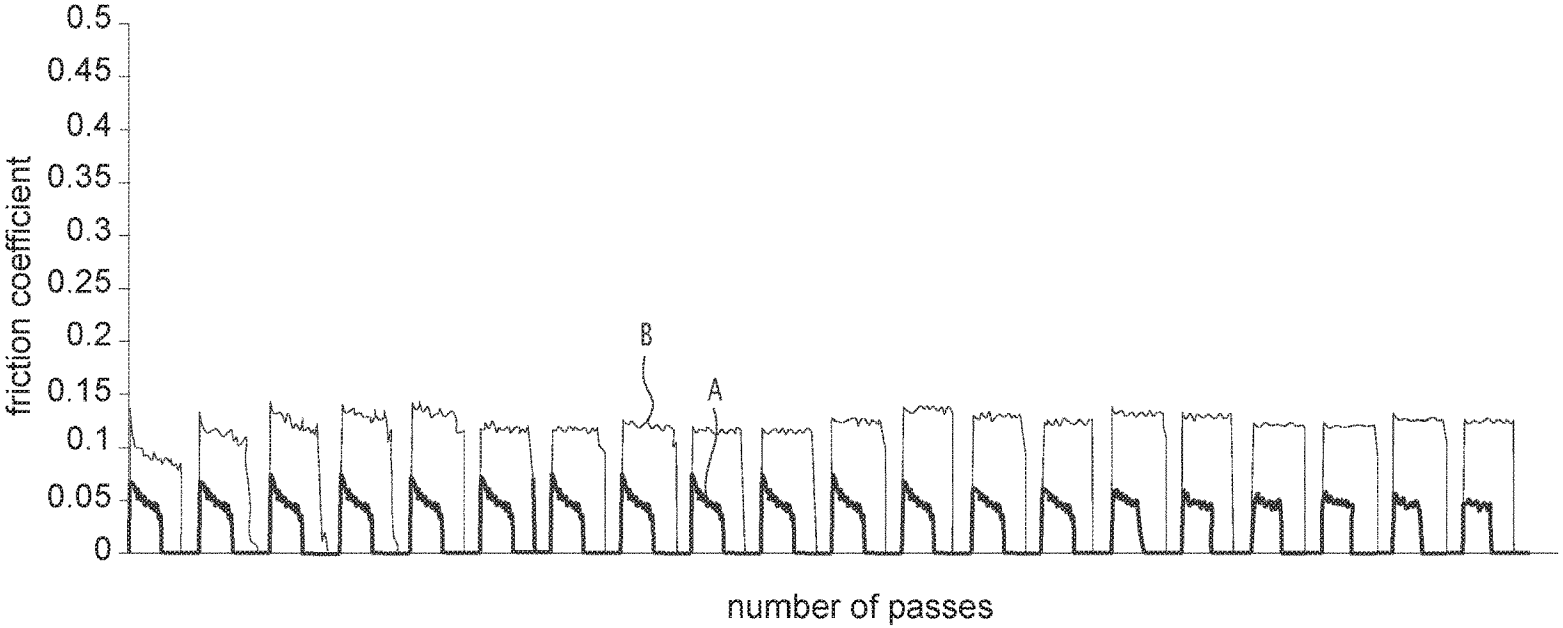
Figure 6:
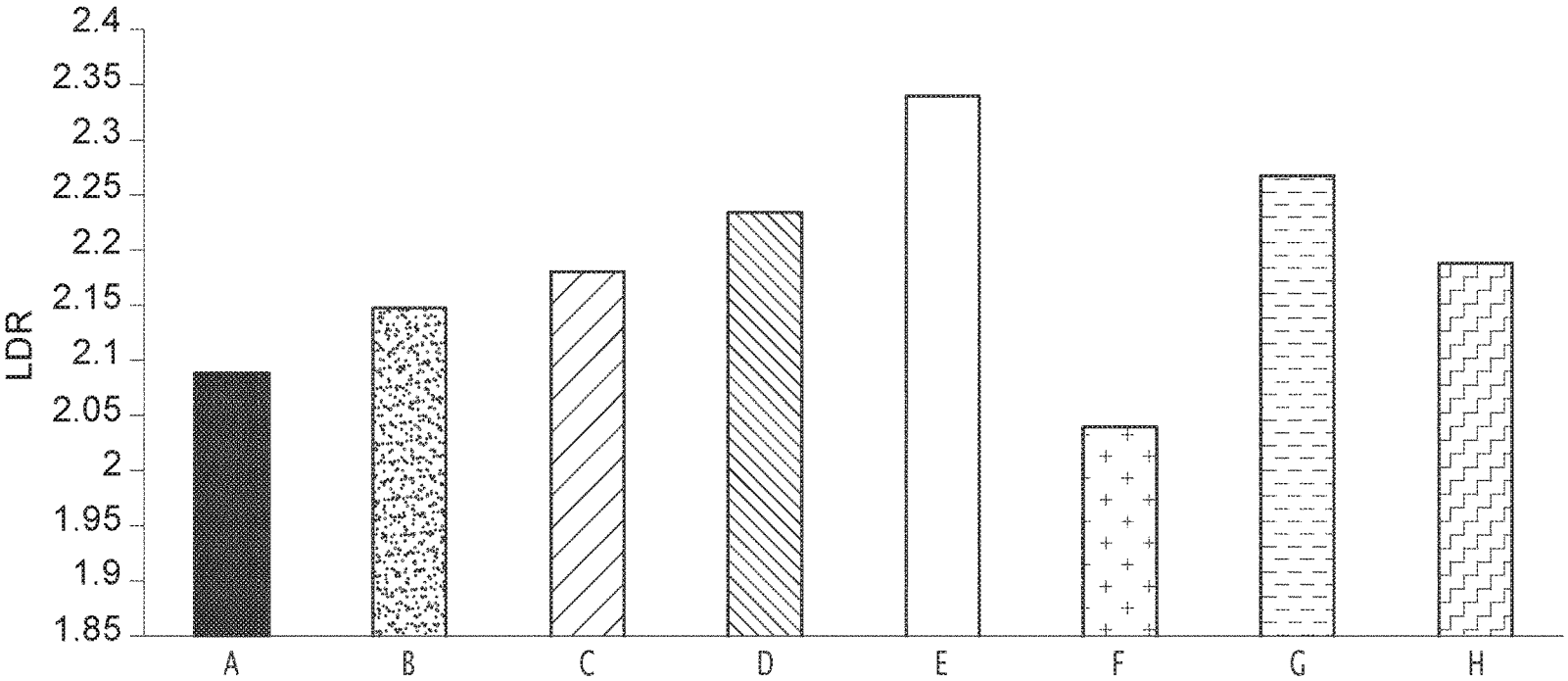
Figure 7:
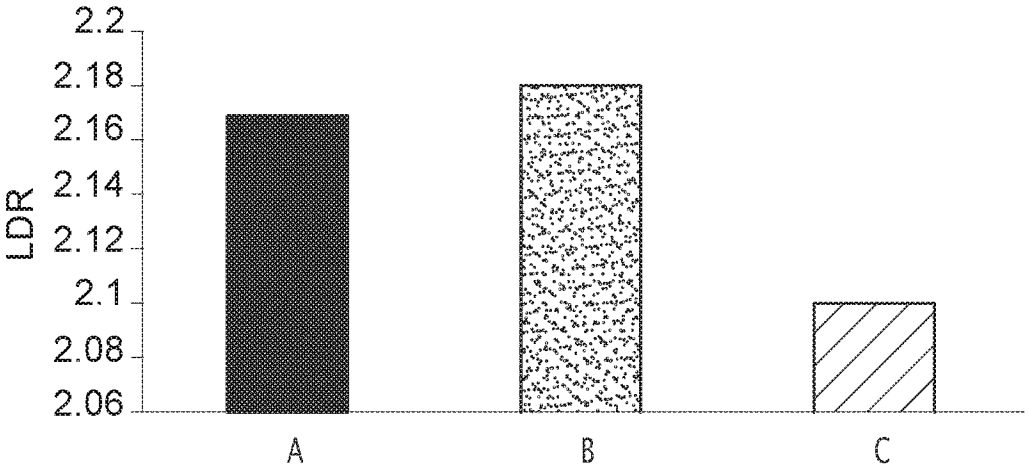
Figure 8:
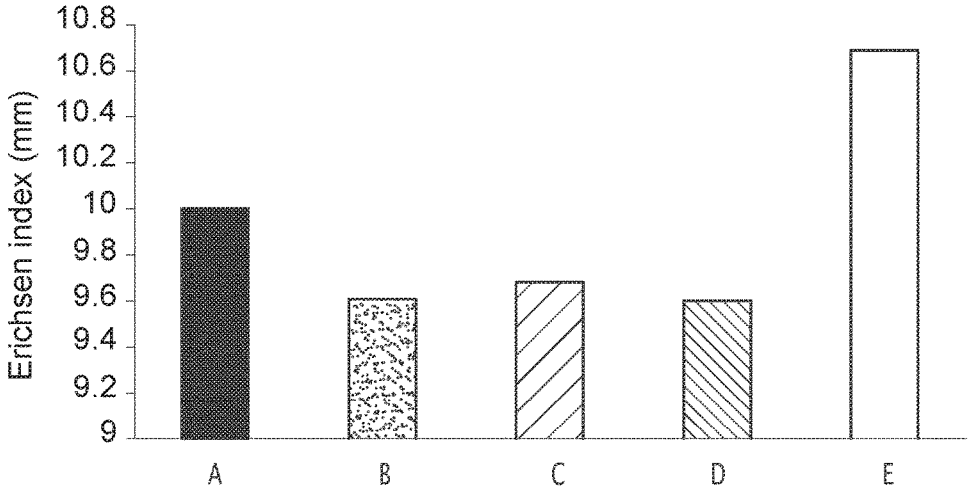

FIG. 5: the friction coefficient μ during a test on a twin-disc tribometer (described in Roizard et al, «Experimental device for tribological measurement aspects in deep drawing process », Journal of Materials Processing Technology, 209 (2009) 1220-1230) for a ferritic-type (grade 1.4509-4441) stainless steel substrate, treated according to the example 139 (A) and with a conventional chlorinated mineral lubricant (RenoForm ETA-Fuchs) (B);

FIG. 6: the LDR (Limit Drawing Ratio) of a ferritic-type (grade 1.4509-4441) stainless steel substrate treated according to different configurations:

according to the examples 141 (A), 145 (B), 149 (C), 153 (D), 139 (E) and 139 with surface rinsing of the heaps by ultrasounds (F);

with the lubricant Molykote G-Rapid Plus (G) and the conventional chlorinated mineral oil Fuchs Renoform ETA (H);

FIG. 7: the LDR (Limit Drawing Ratio) of an austenitic-type (grade 1.4301-304) stainless steel substrate according to the performed lubrication treatment: with the lubricant Molykote G-Rapid Plus (B), the conventional chlorinated mineral oil Fuchs RenoForm ETA (C), and according to the example 59 (A);

FIG. 8: the Erichsen index (equal to the reached maximum depth (in mm) by stamping for equibiaxial expansion type loads) of an austenitic-type (grade 1.4509-441) stainless steel substrate according to the performed lubrication treatment: with the lubricant Molykote G-Rapid Plus (A), the conventional chlorinated mineral oil Fuchs RenoForm ETA (B), the chlorinated mineral oil Total Martol EP180 (C), the non-chlorinated mineral oil Total Martol EPSCF (D), and according to the example 153 (E).

Figure 9:
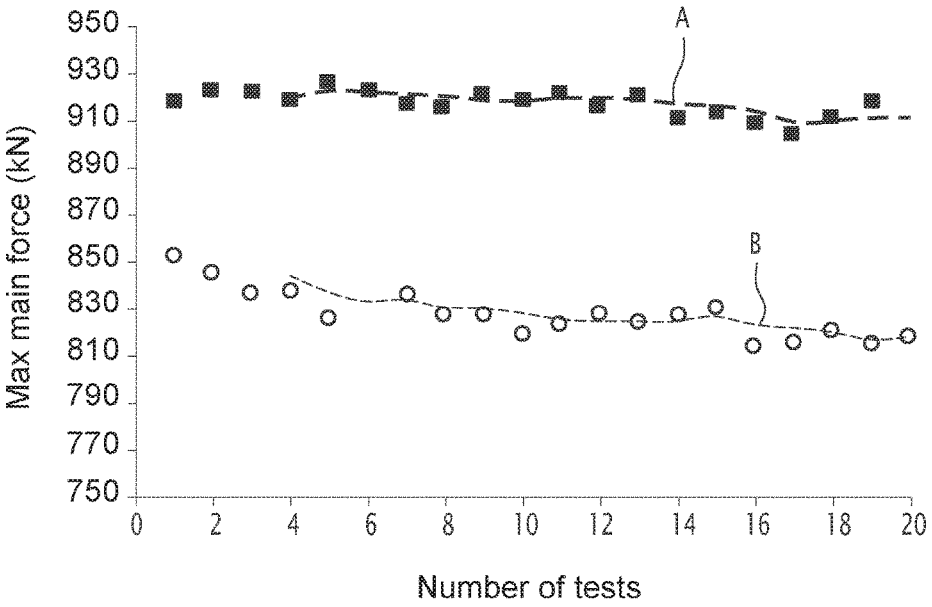

FIG. 9: the evolution of the applied maximum punch force according to the number of parts during a phase of series production on a saucepan-type geometry from austenitic-type (grade 1.4301) stainless steel substrates treated with the chlorinated mineral oil MotulTechCadrex DR136P (A), and according to the example 73 (B).

Figure 10:
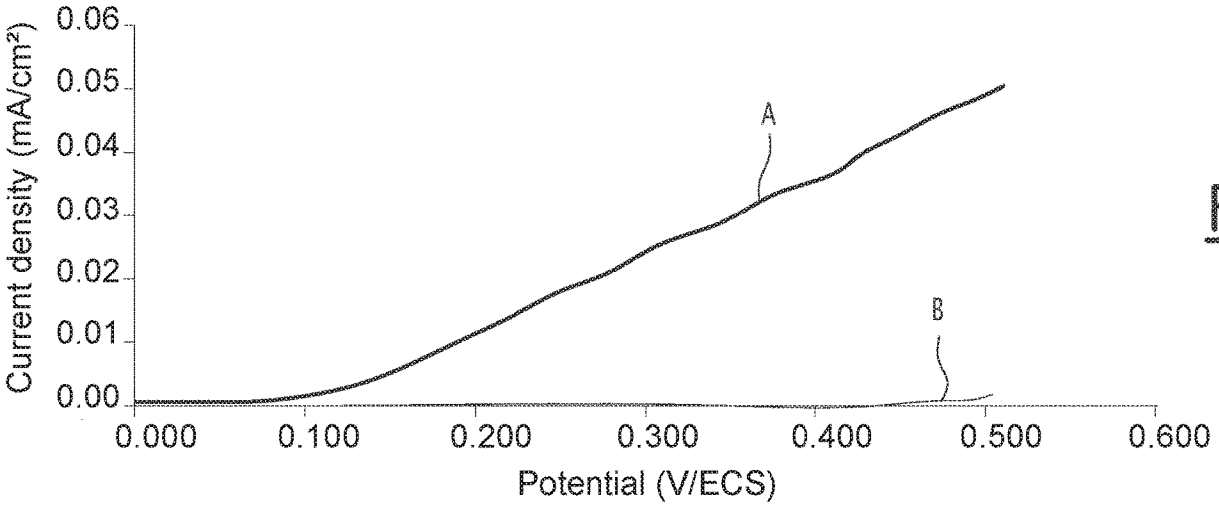

FIG. 10: the current density according to the potential for an austenitic-type (grade 1.4301-304) stainless steel sheet immersed in a hydrochloric acid solution (at 0.3% by weight) non-treated (A) and treated according to the example 59 (B).

Figure 11:
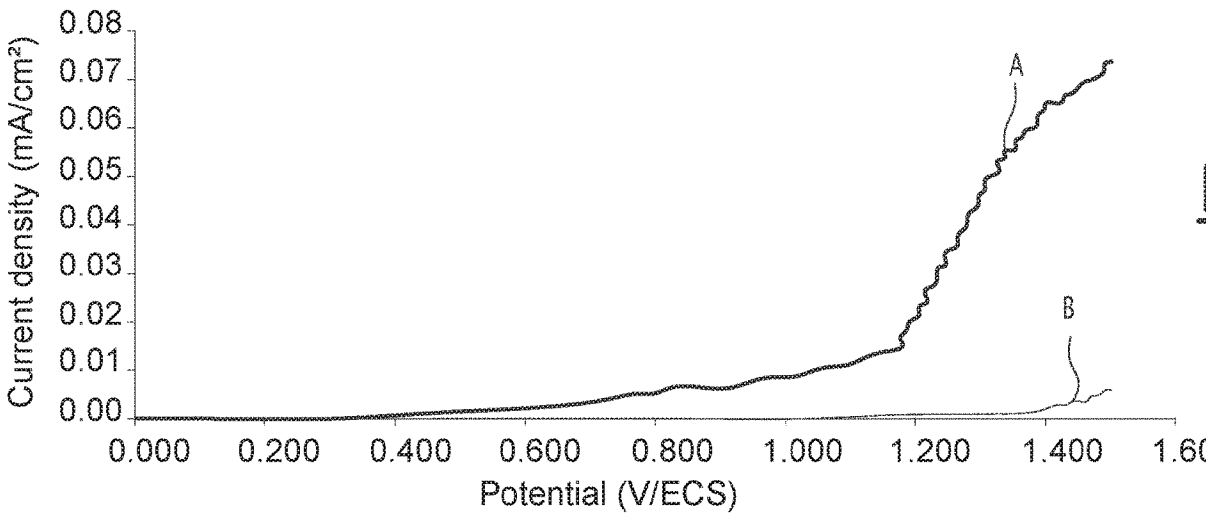

FIG. 11: the current density according to the potential for a ferritic-type (4411.4509-441) stainless steel sheet immersed in a hydrochloric acid solution (at 0.3% by weight) non-treated (A) and treated according to the example 139 (B).

EXAMPLES

Unless otherwise stated, all the tests have been performed at ambient temperature and pressure.

Example A

Synthesis of the n-dodecylphosphonic acid

The halogenated derivative z-A-Br (200 mmol) is heated to 200° C. (oil bath) and the triethylphosphite (210 mmol) added drop-by-drop at this temperature for 30 minutes, while the formed bromoethane is continuously distilled (temperature of the vapor below 40° C.). Afterwards, the mixture is brought to 220-250° C. and maintained at this temperature during 20 minutes. The excess triethylphosphite is eliminated under 50-100 mmHg during 5-10 min and the resulting oil is cooled to ambient temperature. The concentrated aqueous hydrochloric acid (12 M, 250 ml) is added and the heterogeneous mixture is brought to boiling under good stirring for 15 h. After cooling to ambient temperature, the semi-oily mixture crystallizes. The solid is filtered and water-washed until neutral. Afterwards, it is dried under suction at 20° C. The phosphonic acid may be recrystallized in cyclohexane so as to result in plates with an off-white color.

Example B

Synthesis of the n-dexadecylphosphonic acid

Global synthesis protocol analogous to that of Example A.

Examples A1-A10

Preparation of the Grafting Solutions

In a recipient with an adequate volume, equipped with appropriate stirring and heating means, two solutions have been prepared such that:

Solution 1: 850 ml of absolute ethanol and 150 ml of ultrapure water are introduced. Afterwards, in this hydroalcoholic solvent, the organophosphorus compound prepared at example A is introduced in the amount indicated in the table 1 below. The solution is stirred until complete solubilization, if appropriate by heating the solution.

Solution 2: 1000 ml of absolute ethanol are introduced. Afterwards, in this alcoholic solvent, the organophosphorus compound prepared at example A is introduced in the amount indicated in the table 1 below. The solution is stirred until complete solubilization, if appropriate by heating the solution.

Examples B1-B10

Preparation of the grafting solutions

In a recipient with an adequate volume, equipped with appropriate stirring and heating means, two solutions have been prepared such that:

Solution 1: 850 ml of absolute ethanol and 150 ml of ultrapure water are introduced. Afterwards, in this hydroalcoholic solvent, the organophosphorus compound prepared at example B is introduced in the amount indicated in the table 1 below. The solution is stirred until complete solubilization, if appropriate by heating the solution.

Solution 2: 1000 ml of absolute ethanol are introduced. Afterwards, in this alcoholic solvent, the organophosphorus compound prepared at example B is introduced in the amount indicated in the table 1 below. The solution is stirred until complete solubilization, if appropriate by heating the solution.

Table 1 shows the compositions of the grafting solutions obtained in the different examples A1 to A10 and B1 to B10.

TABLE 1

Composition of the grafting solutions

| EXAMPLES | Solution | Group A | Concentration (mol/l) |
|---|---|---|---|
| A1 | 1 | C12 straight alkyl | 0.001 |
| A2 | 1 | C12 straight alkyl | 0.005 |
| A3 | 1 | C12 straight alkyl | 0.01 |
| A4 | 1 | C12 straight alkyl | 0.05 |
| A5 | 1 | C12 straight alkyl | 0.1 |
| A6 | 2 | C12 straight alkyl | 0.001 |
| A7 | 2 | C12 straight alkyl | 0.005 |
| A8 | 2 | C12 straight alkyl | 0.01 |
| A9 | 2 | C12 straight alkyl | 0.05 |
| A10 | 2 | C12 straight alkyl | 0.1 |
| B1 | 1 | C16 straight alkyl | 0.001 |
| B2 | 1 | C16 straight alkyl | 0.005 |
| B3 | 1 | C16 straight alkyl | 0.01 |
| B4 | 1 | C16 straight alkyl | 0.05 |
| B5 | 1 | C16 straight alkyl | 0.1 |
| B6 | 2 | C16 straight alkyl | 0.001 |
| B7 | 2 | C16 straight alkyl | 0.005 |
| B8 | 2 | C16 straight alkyl | 0.01 |
| B9 | 2 | C16 straight alkyl | 0.05 |
| B10 | 2 | C16 straight alkyl | 0.1 |

Examples 1-160

Grafting on austenitic (examples 1-24) and ferritic (examples 25-48) stainless steel A metal substrate, constituted by a 1 mm thick sheet of 189 ED-grade (1.4301-304) austenitic or 441-grade (1.4509-441) ferritic stainless steel respectively, has been treated with the treatment solution prepared as indicated hereinabove according to the following modus operandi.

First, the substrate is degreased and cleaned by immersion in absolute ethanol and treatment by ultrasounds for 5 minutes. Second, the substrate thus prepared is immersed in the chosen treatment solution for a time period of 1 second, 30 minutes (0.5 h), 2 h and 16 h, respectively.

The substrate is not rinsed after treatment. Indeed, this would result in eliminating the layer of physisorbed organophosphorus compound preponderantly crystallized preserving only the monomolecular layer. The improvement of the tribological properties would then be insufficient, and the process would not be a viable solution in comparison with a treatment using oils.

The process has been performed with the different prepared treatment solutions, by varying the time of contact. The treatment parameters of the different samples are indicated in the tables 2, 3, 4 and 5 below.

The substrates thus treated have been characterized as described later on.

TABLE 2

Treatment parameters of an austenitic stainless steel with the solutions prepared according to the examples A1 to A10.

| EXAMPLES | Metal | Grafting solution | Grafting time |
|---|---|---|---|
| 1-4 | Austenitic stainless steel 189 ED | A1 | 1 s; 0.5; 2 and 16 h |
| 5-8 | Austenitic stainless steel 189 ED | A2 | 1 s; 0.5; 2 and 16 h |
| 9-12 | Austenitic stainless steel 189 ED | A3 | 1 s; 0.5; 2 and 16 h |
| 13-16 | Austenitic stainless steel 189 ED | A4 | 1 s; 0.5; 2 and 16 h |
| 17-20 | Austenitic stainless steel 189 ED | A5 | 1 s; 0.5; 2 and 16 h |
| 21-24 | Austenitic stainless steel 189 ED | A6 | 1 s; 0.5; 2 and 16 h |
| 25-28 | Austenitic stainless steel 189 ED | A7 | 1 s; 0.5; 2 and 16 h |
| 29-32 | Austenitic stainless steel 189 ED | A8 | 1 s; 0.5; 2 and 16 h |
| 33-36 | Austenitic stainless steel 189 ED | A9 | 1 s; 0.55; 2 and 16 h |
| 37-40 | Austenitic stainless steel 189 ED | A10 | 1 s; 0.5; 2 and 16 h |

TABLE 3

Treatment parameters of an austenitic stainless steel with the solutions prepared according to the examples B1 to B10.

| EXAMPLES | Metal | Grafting solution | Grafting time |
|---|---|---|---|
| 41-44 | Austenitic stainless steel 189 ED | B1 | 1 s; 0.5; 2 and 16 h |
| 45-48 | Austenitic stainless steel 189 ED | B2 | 1 s; 0.5; 2 and 16 h |
| 49-52 | Austenitic stainless steel 189 ED | B3 | 1 s; 0.5; 2 and 16 h |
| 53-56 | Austenitic stainless steel 189 ED | B4 | 1 s; 0.5; 2 and 16 h |
| 57-60 | Austenitic stainless steel 189 ED | B5 | 1 s; 0.5; 2 and 16 h |
| 61-64 | Austenitic stainless steel 189 ED | B6 | 1 s; 0.5; 2 and 16 h |
| 65-68 | Austenitic stainless steel 189 ED | B7 | 1 s; 0.5; 2 and 16 h |
| 69-72 | Austenitic stainless steel 189 ED | B8 | 1 s; 0.5; 2 and 16 h |
| 73-76 | Austenitic stainless steel 189 ED | B9 | 1 s; 0.55; 2 and 16 h |
| 77-80 | Austenitic stainless steel 189 ED | B10 | 1 s; 0.5; 2 and 16 h |

TABLE 4

Treatment parameters of a ferritic stainless steel with the solutions prepared according to the examples A1 to A10.

| EXAMPLES | Metal | Grafting solution | Grafting time |
|---|---|---|---|
| 81-84 | Ferritic stainless steel 441 | A1 | 1 s; 0.5; 2 and 16 h |
| 85-88 | Ferritic stainless steel 441 | A2 | 1 s; 0.5; 2 and 16 h |
| 89-92 | Ferritic stainless steel 441 | A3 | 1 s; 0.5; 2 and 16 h |
| 93-96 | Ferritic stainless steel 441 | A4 | 1 s; 0.5; 2 and 16 h |
| 97-100 | Ferritic stainless steel 441 | A5 | 1 s; 0.5; 2 and 16 h |

TABLE 4-continued

Treatment parameters of a ferritic stainless steel with the solutions prepared according to the examples A1 to A10.

| EXAMPLES | Metal | Grafting solution | Grafting time |
|---|---|---|---|
| 101-104 | Ferritic stainless steel 441 | A6 | 1 s; 0.5; 2 and 16 h |
| 105-108 | Ferritic stainless steel 441 | A7 | 1 s; 0.5; 2 and 16 h |
| 109-112 | Ferritic stainless steel 441 | A8 | 1 s; 0.5; 2 and 16 h |
| 113-116 | Ferritic stainless steel 441 | A9 | 1 s; 0.55; 2 and 16 h |
| 117-120 | Ferritic stainless steel 441 | A10 | 1 s; 0.5; 2 and 16 h |

TABLE 5

Treatment parameters of a ferritic stainless steel with the solutions prepared according to the examples B1 to B10.

| EXAMPLES | Metal | Grafting solution | Grafting time |
|---|---|---|---|
| 121-124 | Ferritic stainless steel 441 | B1 | 1 s; 0.5; 2 and 16 h |
| 125-128 | Ferritic stainless steel 441 | B2 | 1 s; 0.5; 2 and 16 h |
| 129-132 | Ferritic stainless steel 441 | B3 | 1 s; 0.5; 2 and 16 h |
| 133-136 | Ferritic stainless steel 441 | B4 | 1 s; 0.5; 2 and 16 h |
| 137-140 | Ferritic stainless steel 441 | B5 | 1 s; 0.5; 2 and 16 h |
| 141-144 | Ferritic stainless steel 441 | B6 | 1 s; 0.5; 2 and 16 h |
| 145-148 | Ferritic stainless steel 441 | B7 | 1 s; 0.5; 2 and 16 h |
| 149-152 | Ferritic stainless steel 441 | B8 | 1 s; 0.5; 2 and 16 h |
| 153-156 | Ferritic stainless steel 441 | B9 | 1 s; 0.55; 2 and 16 h |
| 157-160 | Ferritic stainless steel 441 | B10 | 1 s; 0.5; 2 and 16 h |

A. Surface tension

In order to highlight the presence of the coating and more specifically of the monomolecular layer, the samples have been specially rinsed upon completion of the treatment in order to remove the physisorbed layer. Afterwards, the surface tension has been assessed before and after the treatment of the substrate with the solution B5 (with rinsing) for the (ferritic and austenitic) stainless steel substrates and with the solution A3 (with rinsing) for the aluminum and copper substrates.

The surface tension of the different metal substrates has been assessed according to the methods of Owens and Wendt, from contact angles obtained with three distinct liquids (diiodomethane, ethylene glycol, water) whose polar $\gamma_l^P$ and dispersive $\gamma_l^D$ components are known and disclosed in the table 6.

TABLE 6

Surface energies of the considered liquids. Details of the polar and dispersive components.

| | $\gamma_L$ mJ/m$^2$ | $\gamma_L^d$ mJ/m$^2$ | $\gamma_L^P$ mJ/m$^2$ |
|---|---|---|---|
| Water | 72.8 | 21.8 | 51 |
| Ethylene glycol | 48 | 29 | 19 |
| Diiodomethane | 50.8 | 50.8 | 0 |

Indeed, the measurement of the contact angle enables the calculation of the total surface tension (as well as the polar and dispersive components) based on the following Young's formula:

$$\gamma_{SV}=\gamma_{SL}+\gamma_{LV}\cos\theta$$

The measurement and calculations results are compiled in the table 7 below. For all samples, the treatments (immersion in the solution) have lasted 2 h.

TABLE 7

Effect of the treatment on the surface tension of the metal surfaces

| Metal | | Contact angle [°] | Surface tension [mJ/m$^2$] |
|---|---|---|---|
| Ferritic stainless steel | Non-treated | 92 | 24.7 |
| | Treated (EX. 139) | 115 | 18.5 |
| Austenitic Stainless steel | Non-treated | 15 | 66.5 |
| | Treated (EX. 59) | 100 | 18.5 |
| Aluminum | Non-treated | 3 | 47 |
| | treated | 115 | 15 |
| Copper | Non-treated | 96 | 38.1 |
| | treated | 125 | 21.9 |

These tests have allowed confirming the presence of an active species at the surface of the treated substrates. Moreover, they have allowed validating the possibility of treating different metal substrates by means of the process of the invention.

By analyzing the results, a very clear decrease of the surface tension is noted, indicating a more polar and therefore a more hydrophobic nature of the surfaces (increase of the contact angle). The very homogeneous results for different samples and sites on the surfaces reveal the obtainment by the process of the invention of a complete and homogeneous coverage of the treated surface for the long exposure durations, and a sufficient coverage, even though not complete, for the short, and even very short (1 s), exposure durations. FIG. 4 highlights the evolution of said coverage rate in the case of an austenitic stainless steel according to the immersion times, respectively from 1 s to 16 h. Thus, it is set out the fact that 19% of the surface is already covered by a monomolecular layer after an immersion time of 1 s whereas this rate rises to 41%, 85% and 94% for immersion times of 30 minutes, 2 hours and 16 hours, respectively.

Moreover, it is remarked that the surface tension, different for each of the non-treated substrates, tends to be aligned for the treated substrates, at a value close to 18.5 mJ/m$^2$, thereby reflecting the sole contribution of the monomolecular layer in the apparent surface tension of the tested sample when the immersion time justifies, the existence of a sufficient monomolecular layer to obtain this effect, said immersion time may be of 2 h, and even lesser, according to the given experimental results.

B. Friction coefficient

In order to assess the effect of the treatment process of the invention on the tribological properties of the metal, the treated samples have been characterized by means of a twin-disc tribometer, representative of the stamping conditions.

In this device, the floating portions are cylindrical and come into lineal (or pseudo-lineal when considering a Hertz contact pressure) direct contact with the substrate to be tested via two arms forming a clamp, actuated by a pneumatic cylinder. In the tests reported herein, the cylinders are made of a tool steel Z160CD12. They exert an average normal force (perpendicular to the surface of the treated substrate) of 4000 N and are animated at a defined speed of 10 mm/min. The small contact surface obtained thanks to this particular geometry of the tool (in comparison with a plane/plane contact) enables access to a finer study of the friction, in particular allowing obtaining a more accurate evolution of the friction coefficient according to the friction distance (discretization of the friction=n passes depending on the desired friction distance).

Through the measurement of the tangential force resulting from the displacement of the cylindrical tools rotatably fixed on the treated metal substrate, the friction coefficient has been calculated according to the following formula:

$$\mu=\frac{F_t}{2F_n}$$

where Fn is the applied normal force and Ft is the resulting tangential force.

The evolution of the friction coefficient according to the number of passes (according to the friction distance) is illustrated by FIG. 5. Both concern a ferritic (4441-1.4509) stainless steel substrate. FIG. 5 offers a performances comparison between (curve B) a commonly used industrial oil (oil RenoForm ETA commercialized by Fuchs Lubrifiants France) and (curve A) a treatment of the substrate by the present invention according to the example 139.

Upon completion of a treatment preconized by the present invention, the measured friction coefficient is in the range of 0.05 and turns out to be constant during the different passes. This denotes a very good tribological behavior, which, what's more, is without any substantial alteration overtime.

The results highlight a very clear improvement of the tribological properties by the treatment according to the process of the invention. In particular, the metals treated according to the invention have a friction coefficient lower than that obtained by treatment with a high-performance oil according to the state of the art.

C. Deep-drawability

The deep-drawability is a major factor in the shaping of materials. Indeed, a metal having a good deep-drawability enables the use of severe stamping industrial conditions allowing in particular minimizing the number of passes required to confer the desired shape to the substrate. This deep-drawability is a complex combination of the elasto-plastic mechanical properties of the matter, of the lubrication conditions and of the used process parameters (tools type, tools kinematics, . . . ).

In order to assess the effect of the treatment process on the deep-drawability, the treated substrates have been characterized by stamping following a restricted-type deformation path through the determination of the LDR («Limit Drawing Ratio ») for different lubrication conditions. In this test, an initial disc with a diameter D is deep-drawn by a punch with a fixed diameter d (d=33 mm). As soon as the operation is considered as successful (realization of the part without breakup), the diameter D of the deep-drawn disc is increased by successive steps of 4 mm and this, until obtaining the first broken-up part. The maximum diameter, denoted $D_{max}$, of the last deep-drawn disc before breakup of the material is then collected to allow the calculation of the limit stamping ratio defined as the ratio LDR=$D_{max}$/d. This ratio is characteristic of each metal substrate and of the associated lubrication conditions. Hence, the comparison between a sheet metal lubricated with a common industrial oil and a sheet metal treated by the present invention allows characterizing the effectiveness of the lubricant herein proposed, at strictly equivalent matter properties and process parameters. The higher is the obtained LDR value, the better is the lubricity of the used lubricant.

The obtained results are illustrated through FIGS. 6 and 7.

Table 8 synthesizes the results thus obtained for austenitic-type (1.4301-304) and ferritic-type (14509-441) stainless steel substrates in various lubrication configurations. It should be noted that the tools themselves are made of non-coated steel Z160CDV12, without any modification during the different tests. The data relating to the ferritic (1.4509-441) and austenitic (1.4301-304) stainless steels are taken up respectively by FIGS. 6 and 7.

TABLE 8

Effect of the treatment of the invention on the deep-drawability

| | Metal | Lubricant | LDR |
|---|---|---|---|
| Austenitic stainless steel 304 (FIG. 7) | Treated (example 59) | — | 2.17 (A) |
| | Non-treated | RenoForm ETA (Oil commercialized by Fuchs Lubrifiants France) | 2.10 (C) |
| | Non-treated | Molykote G-Rapid Plus (Solid lubricating paste commercialized by Dow Corning) | 2.18 (B) |
| Ferritic stainless steel 441 (FIG. 6) | Treated (example 141) | — | 2.09 (A) |
| | Treated (example 145) | — | 2.15 (B) |
| | Treated (example 149) | — | 2.18 (C) |
| | Treated (example 153) | — | 2.24 (D) |
| | Treated (example 139) | — | 2.35 (E) |
| | Treated (example 139 + rinsing and removal of the 2$^{nd}$ layer) | — | 2.04 (F) |
| | Non-treated | RenoForm ETA (Oil commercialized by Fuchs Lubrifiants France) | 2.20 (G) |
| | Non-treated | Molykote G-Rapid Plus (Solid lubricating paste commercialized by Dow Corning) | 2.28 (H) |

A first series of tests has been conducted on an austenitic 304 stainless steel grade according to the example 59 or non-treated according to the invention but coated with different conventional lubricants (FIG. 7). Complementarily to this first series of tests, a second series has been performed on a ferritic 441 stainless steel grade treated according to different examples, namely the examples 141, 145, 149, 153, 139 and 139 with the addition of an intentional post-treatment rinsing in order to remove, for this last configuration, the second layer of molecules of the organophosphorus compound at least preponderantly crystallized. Complementarily to these treatments, in a manner similar to that which has been done for the austenitic 304 stainless steel grade, tests have been carried out on a sheet metal non-treated but coated with different conventional lubricants (FIG. 6). It should be noted that the lubricant Renoform ETA is a chlorinated mineral oil commonly used industrially whereas the solid lubricating paste Molykote G-Rapid Plus is a product used at a laboratory scale (or for a non-automatized production of a small-series) with a very high lubricity rarely equalled by conventional industrial oils.

It is observed from the results of these tests that the substrates obtained according to the invention have stamping characteristics, equivalent to and even higher than those obtained using high-performance lubricants. A clear effect of the initial concentration of organophosphorus molecules on the performance is set out by these results: a higher concentration induces a much better performance of the product. In addition, the test performed according to the example 139 with the removal of the second layer of molecules of the organophosphorus compound (F) reflects the necessity of preserving this second layer of physisorbed molecules at least preponderantly crystallized in order to enhance the performance of the product, and this, although the monomolecular layer obtained by the treatment of the example 139 induces a considerable coverage rate.

Complementarily to the determination of the LDR levels, a second stamping test has been performed in order to validate the performance of the product following an equibiaxial expansion type loading path: the Erichsen test. In the context of this test, the matter engulfing during the shaping operation is avoided by the application of a sufficient die-cushion force (10 kN) so that no slip has occurred under the gripping of the tools. The only slips encountered in the context of this test are localized between the sheet metal and the hemispherical punch with a 20 mm diameter (made of tool steel Z160CDV12) during the vertical displacement operated by the latter. Table 9 synthesizes the results obtained on a ferritic (14509-441) stainless steel grade treated according to the example 153 or non-treated but coated with different conventional lubricants. The data relate to a ferritic (14509-441) stainless steel and are taken up in FIG. 8.

TABLE 9

Effect of the treatment of the invention on the deep-drawability

| | Metal | Lubricant | Erichsen index |
|---|---|---|---|
| Ferritic stainless steel 441 | Treated (example 153) | — | 10.7 (E) |
| | Non-treated | RenoForm ETA (Oil commercialized by Fuchs Lubrifiants France) | 9.6 (D) |
| | Non-treated | Molykote G-Rapid Plus (Solid lubricating paste commercialized by Dow Corning) | 10.0 (A) |
| | Non-treated | Martol EP180 (Oil commercialized by Total) | 9.7 (C) |
| | Non-treated | Martol EP5CF (Oil commercialized by Total) | 9.6 (B) |

It is observed from the results of these tests that the substrate obtained according to the invention has stamping characteristics and performances clearly higher than those of the equivalent substrates non-treated but coated with more conventional lubricants dedicated to the production of large or small series. The performance gain inherent to a treatment according to the present invention is estimated herein to be 10%.

In order to definitively validate the effectiveness of the present invention in an industrial scale, tests have been carried out on an industrial press under production conditions, at a production rate of more than 4 parts per minute. The realized part corresponds to a saucepan with a 240 mm diameter. The latter may be considered as difficult to manufacture considering the induced forces, in all cases greater than 800 kN. All of the used tools are integrally coated with a TiCN coating in order to minimize the frictions generated during the stamping phase.

FIG. 9 illustrates the results obtained on an austenitic (1.4301-304) stainless steel substrate treated according to the example 73 (curve B) or non-treated but coated with an industrial lubricant MotulTechCadrex DR136P, which is a chlorinated lubricant commonly used on the present production tool (curve A). Said lubricant further necessitates a costly post-stamping degreasing step. It should be noted that a considerable difference exists between the two series of realized parts illustrated by FIG. 9 as regards the initial lubrication conditions before stamping. Whereas in the case of the use of the conventional lubricant MotulTechCadrex DR136P, the tools themselves are coated with the lubricant before the stamping of the first part as is usually practiced, said tools turn out to be clean and dry at the beginning of the production in the case of the substrates coated according to the example 73 of the invention. Nevertheless, it appears very clearly that no deterioration of the performance is observed during the stamping of said first parts. Still furthermore, a significant decrease of the maximum force applied by the press is clearly observable on the entire series of 20 parts herein produced via the treatment proposed by the present invention. This force decrease, in the range of 10%, allows a direct and evident reduction of the energy necessary for the realization of the parts. It further allows considering realizing parts for which the machine capacity may initially appears insufficient considering the forces necessary for their realization through the use of a conventional lubricant. In addition, no post-stamping degreasing is herein necessary, thereby inducing an evident direct gain in productivity.

D. Corrosion resistance

In order to assess the effect of the treatment process of the invention on the corrosion resistance of the metal, two treated sheet metals have been characterized by voltammetry in an acid environment. The experimental conditions of this test are compiled in table 10 below.

TABLE 10

| Experimental conditions of the voltammetric test | | |
|---|---|---|
| Three-electrode electrochemical cell | Working electrode | Substrate to be tested |
| | Counter electrode | Platinum |
| | Reference electrode | Saturated calomel |
| Solvent | HCl 0.5% | airy ambient temperature |
| Slew rate | 10 mV/s | |

The obtained curves correspond to voltammograms indicating the current density according to the potential applied to the metal immersed in the hydrochloric acid solution.

The measurements have been performed on austenitic-type (1.4301-304) and ferritic-type (1.4509-441) stainless steels treated respectively according to the examples 59 and 139 (curves B) as well as on the non-treated corresponding metals for comparison (curves A).

The obtained voltammograms are illustrated in FIGS. 10 and 11 respectively.

It is observed that the behavior of the stainless steel sheets is considerably modified by the treatment according to the invention. In both studied cases, for an equivalent applied potential, the treatment according to the invention significantly reduces the current density. Thus, it is possible to define blocking rates thereof, 99% and 95% respectively, corresponding to a marked corrosion inhibitory effect of our invention.

Hence, the performed studies also confirm the substantial interest of the process of the invention with regard to protection against corrosion.

Thus, the process of the invention allows access to metal substrates having advantageous characteristics such as a low friction coefficient, an excellent deep-drawability, and in addition, advantageously, a high corrosion resistance.

The process is simple and rapid to implement and does not require any specific equipment. It implements small amounts of barely toxic and low-cost compounds. The avoidance of the use of a lubricating oil during the transformation allows substantial savings, including on indirect costs (workforce, degreasing apparatuses . . . ), and avoids the production of wastes potentially dangerous for the environment.

The metal substrates treated by the process of the invention have substantial advantages since they greatly facilitate, thanks to their pre-lubrication, their subsequent shaping and are also protected against corrosion.

Hence, the surface treatment of metal substrates according to the invention, by deposition of a coating of organophosphorus compounds in different forms, brings in a real improvement of the tribological properties of the material without requiring a classical lubricant in addition to said coating.

The invention claimed is:

1. A metal substrate, the surface of which being coated with (i) at least an organophosphorus compound in the form of a first monomolecular layer coating at least 15% of the surface of the substrate and (ii) a second layer in the form of a physisorbed second layer of organophosphorus molecules at least preponderantly crystallized, said second layer being physisorbed on said first monomolecular layer.

2. Metal substrate according to claim 1, wherein the at least one organophosphorus compound is of formula (I) below

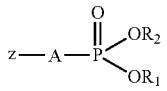

(I)

wherein

A represents a hydrocarbon chain, saturated or unsaturated, straight or branched, comprising 4 to 28 atoms of carbon, the chain may be substituted with one or several group(s) selected from the group consisting of hydroxy, amino, cyano, halogen, sulfonic acid, and organophosphonic acid and/or interrupted by one or several atom(s) or group(s) selected from the group consisting of O, HN, and SH;

Z represents one or several terminal functional group(s) selected from the group consisting of alcohol, aldehyde, carboxylic acid, organophosphonic acid, thiol, amine, halogen, cyano, and silane, or is absent; and $R_1$ and $R_2$ are, independently of each other, a hydrogen or a saturated alkyl, straight or branched, comprising 1 to 18 atoms of carbon.

3. Metal substrate according to claim 2 in which A represents a saturated alkyl group and/or a straight alkyl group.

4. Metal substrate according to claims 1, wherein the substrate is made of aluminum, copper, chromium, titanium, zinc, gold, silver, ruthenium, rhodium, or any of their alloys.

5. Metal substrate according to claim 1, wherein it consists of a flat product.

6. Process for the preparation of a metal substrate according to claim 1, comprising the following steps:

(i) providing a metal substrate including hydroxyl groups at its surface;

(ii) bringing the metal substrate into contact with a solution of at least one organophosphorus compound;

said substrate being not rinsed after treatment according to step (ii).

7. The process according to claim 6, wherein a solvent used for preparing the solution of organophosphorus compound comprises an alcohol, and/or water.

8. The process according to claim 7, wherein the alcohol is an alcohol selected from the group consisting of methanol, ethanol, propanol, isopropanol, and butanol.

9. The process according to claim 6, wherein the solution has a concentration in organophosphorus compound of more than 1 mM/l.

10. The process according to claim 9, wherein the solution of the organophosphorus compound is supersaturated.

11. Metal substrate according to claim 2 in which A represents a hydrocarbon chain, saturated or unsaturated, straight or branched, comprising 16 carbon atoms, the chain may be substituted with one or several group(s) selected from the group consisting of hydroxy, amino, cyano, halogen, sulfonic acid, and organophosphonic acid and/or interrupted by one or several atom(s) or group(s) selected from the group consisting of O, HN, and SH.

* * * * *